United States Patent [19]

Mittermaier

[11] 4,257,622

[45] Mar. 24, 1981

[54] SKI STOP ASSEMBLY

[75] Inventor: Gunther Mittermaier, Tahoe City, Calif.

[73] Assignee: Anthony P. Manino, San Mateo, Calif.

[21] Appl. No.: 971,020

[22] Filed: Dec. 19, 1978

[51] Int. Cl.[3] ..... A63C 7/10

[52] U.S. Cl. ..... 280/605

[58] Field of Search ..... 280/603, 604, 605, 601, 280/11.12

[56] References Cited

U.S. PATENT DOCUMENTS

| | | | |
|---|---|---|---|
| 2,456,002 | 12/1948 | Jonette | 280/605 |
| 2,997,309 | 8/1961 | Van Natter | 280/605 |
| 3,715,126 | 2/1973 | Schwarz | 280/605 |
| 3,741,575 | 6/1973 | Bortoll | 280/605 |
| 3,930,659 | 1/1976 | Salomon | 280/605 |
| 4,012,057 | 3/1977 | Courvoisier | 280/605 |
| 4,033,602 | 7/1977 | Spieldiener et al. | 280/605 |
| 4,078,824 | 3/1978 | Riedel | 280/605 |

FOREIGN PATENT DOCUMENTS

| | | | |
|---|---|---|---|
| 2539974 | 3/1977 | Fed. Rep. of Germany | 280/605 |
| 2301275 | 2/1975 | France | 280/605 |
| 65482 | 11/1942 | Norway | 280/605 |

*Primary Examiner*—John J. Love
*Assistant Examiner*—Michael Mar
*Attorney, Agent, or Firm*—Phillips, Moore, Weissenberger, Lempio & Majestic

[57] ABSTRACT

A ski stop assembly 12 including a pair of elongated members 14, 16 mounted for rotation with respect to each other about a common axis on the side of a ski. The ski stop assembly includes a torsion spring sandwiched between the elongated members and urging them to rotate with respect to each other to a position in which they extend at an angle to the axis of elongation of the ski. A preferred embodiment of the invention is described in which a pair of elongated members is mounted at each side of a ski. A preferred mounting structure is described.

6 Claims, 9 Drawing Figures

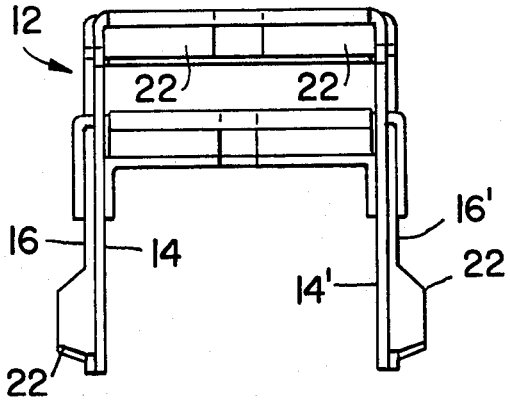
FIG_6
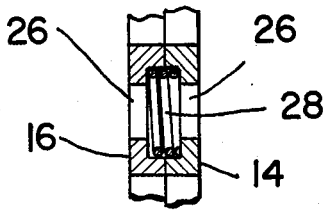
FIG_8
FIG_7
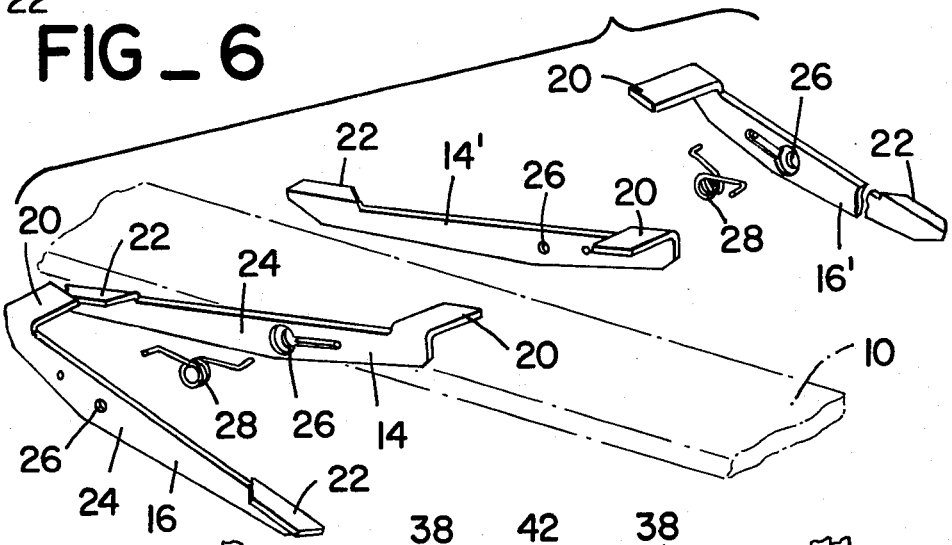
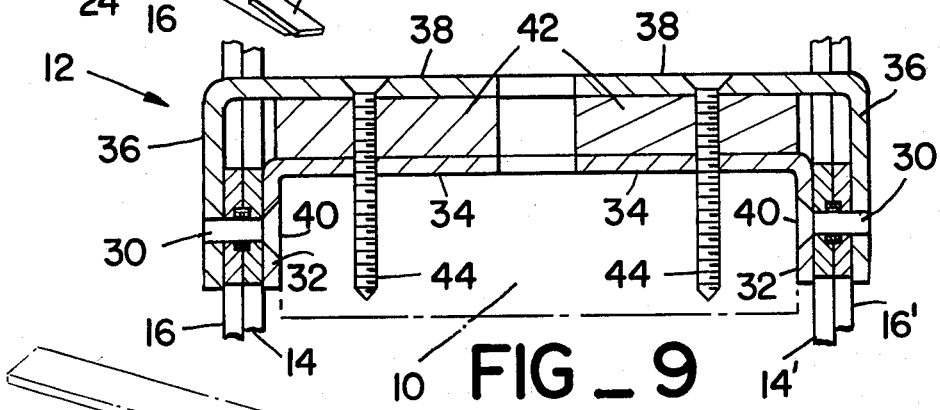
FIG_9
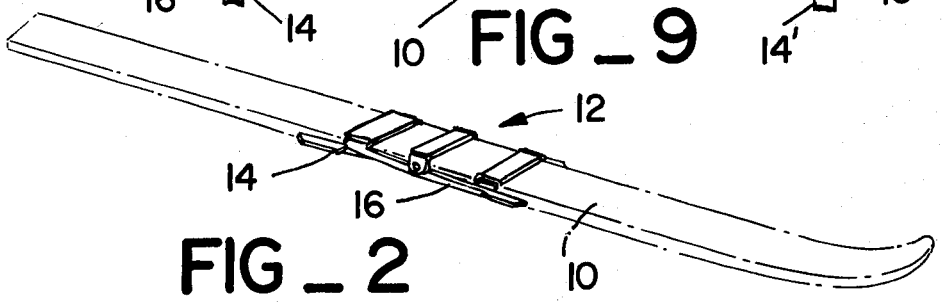
FIG_2

SKI STOP ASSEMBLY

DESCRIPTION

1. Technical Field

This invention relates to a ski stop assembly for impeding the sliding movement of a ski upon release of the ski from a skier's boot and more particularly to an improved ski stop assembly which will reliably impede both forward and backward sliding movement of the ski.

2. Background Art

In order to avoid injury while skiing it is customary to use quick release bindings to attach the skis to the skier's boots. Thus in the event of a fall at high speeds or other accident the skis will be released from the skier's boot in order to reduce the incidence of leg injuries.

However, when a ski is released from a skier's boot it will tend to continue its sliding movement down the slope and could injure other skiers or become lost. Thus, safety straps or lines are often used to prevent the skis from becoming separated by any substantial distance from the skier upon release of the skis from the skier's boot. This eliminates the risk of loss or of injury to other skiers but may result in injury to the skier himself since the ski will be forced to follow the skier and may strike and injure him in the event of a high speed fall.

It has been proposed heretofore to provide each ski with a brake assembly that will be automatically activated upon release of the ski from the skier's boot. Such brake assemblies conventionally include a lever member mounted on the ski for pivotal movement from a position in alignment with the ski above the lower surface thereof to a position in which the lever member projects below the lower surface of the ski.

Prior art ski stop assemblies which include a single lever member at one or both sides of the ski have been ineffective in impeding sliding motion of the ski in more than one of the forward and backward directions and it has been proposed to provide a pair of lever members at one or both sides of the ski with each lever member of the pair specifically adapted to impede sliding movement of the ski in a different one of the two directions longitudinally of the ski. However, such devices have been mechanically complex and, thus, are susceptible to clogging with snow and ice in use rendering them inoperative when needed.

DISCLOSURE OF THE INVENTION

The present invention is directed to overcoming one or more of the problems as set forth above.

According to the present invention, the ski stop assembly comprises a pair of elongated members of the same given length substantially greater than the thickness of the ski. The elongated members each have first and second flanges projecting laterally therefrom in opposite directions at opposite ends thereof with the portion of each elongated member intermediate the first and second flanges thereof being rectilinear. The elongated members each have an aperture therethrough at the same given point intermediate the first and second flanges thereof. Means are provided for mounting the pair of elongated members on a side of the ski with the first flange of each member extending over the top of the ski for engagement by the bottom of the skier's boot and the second flange extending away from the side of the ski. The means for mounting the pair of elongated members includes an axle member extending normally to the axis of elongation of the ski and received through the apertures in the elongated members to enable rotation of the elongated members in opposite directions with respect to each other about a common axis between a first position in which the first flanges of the members are spaced above the top of the ski with the second flanges projecting below the bottom of the ski and a second position in which the first flanges of the elongated members are substantially in contact with the top of the ski with the second flanges in substantial alignment with the side of the ski. A torsion spring is received about the axle and between the pair of elongated members which torsion spring urges the pair of elongated members to rotate in opposite directions about the axle toward their first position with respect to the ski. Means are provided for stopping the rotation of the elongated members toward such first position thereof with the elongated members extending at an angle with respect to the ski.

BRIEF DESCRIPTION OF THE DRAWING

FIG. 2 is a perspective view similar to FIG. 1 showing a ski in phantom with a ski stop assembly according to a preferred embodiment of the teaching of this invention shown in full as mounted on the ski with the elements thereof in the position to which they would be moved by the attachment of the ski to the boot of the skier.

FIG. 6 is an end view in elevation of FIG. 5.

FIG. 7 is an exploded view in perspective showing two pairs of elongated members and a torsion spring associated with each pair in position to be assembled on opposite sides of a ski with a portion of the ski shown in phantom.

FIG. 8 is an enlarged fragmentary cross-sectional view of a portion of a pair of elongated members as shown in FIG. 7 in assembled relation with the torsion spring captured therebetween.

FIG. 9 is an enlarged fragmentary cross-sectional view taken along line 9—9 of FIG. 5.

BEST MODE FOR CARRYING OUT THE INVENTION

Figure 1:
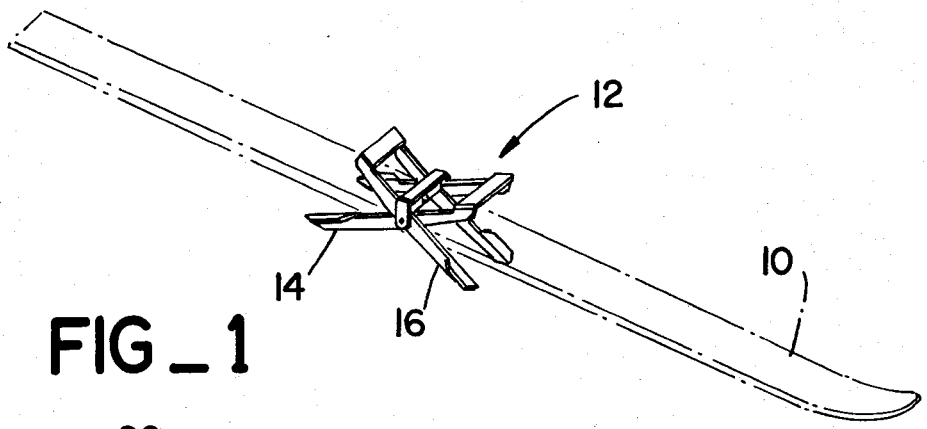
FIG. 1 is a perspective view of a ski shown in phantom with a ski stop assembly according to a preferred embodiment of this invention shown in full as mounted on the ski and with the elements thereof in the position they would automatically assume upon removal of the ski from the boot of the skier.

Referring to FIGS. 1 and 2 a perspective view of a conventional ski 10 is shown in phantom. The showing of the ski 10 has been simplified for ease in understanding this invention by omitting the showing of the tread and associated quick release binding which are conventionally provided on the upper surface of the ski for attachment of the ski to the boot of the skier. However, a ski stop assembly 12 according to a preferred embodiment of this invention is shown in full as mounted on the ski 10 at the tread portion of such ski 10 for engagement by the boot of the skier in use.

In FIG. 1 the elements of the ski stop assembly 12 are shown in the position they will automatically assume when the ski 10 is released from the boot of the skier. In FIG. 2 the elements of the ski stop assembly 12 are shown in the position which they will be forced to assume when the ski 10 is attached to the boot of a skier (not shown) by means of conventional quick release bindings (not shown) provided on the upper surface of the ski 10.

Figure 3:
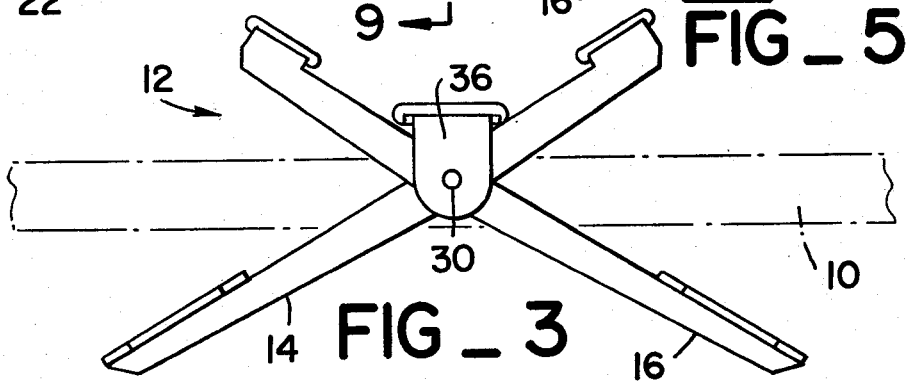
FIG. 3 is an enlarged fragmentary side view in elevation of the ski stop assembly of FIG. 1.

Referring to FIG. 3 a side view in elevation of the ski stop assembly 12 is shown with the elements thereof in the position shown in FIG. 1. As shown in FIGS. 1 and 3, the active elements of a ski stop according to the teaching of this invention are a pair of elongated members mounted for pivotal movement about a common axis at each side of the ski 10. As will be more fully discussed hereinafter, the two pairs of elongated members 14 and 16 are identical and the elongated members 14 and 16 of one pair are physically distinct from the elongated members of the other pair as will be more fully described hereinafter. The two pairs of elongated members 14 and 16 operate in the same manner. A single pair of elongated members 14 and 16 mounted at one side of the ski 10 will be sufficient to impede either forward or backward sliding movement of the ski 10 when in the position shown in FIG. 3 and embodiements of this invention utilizing a single pair of elongated members are contemplated.

As will be more fully discussed hereinafter, the elongated members 14 and 16 are spring loaded to urge them into the position shown in FIG. 3. In such position a portion of each of the elongated members 14 and 16 extend above the top surface of the ski and another portion of each of the elongated members 14 and 16 extend below the lower surface of the ski 10. The portions of the elongated membes 14 and 16 which extend below the lower surface of the ski 10 are adapted to dig into the snow and thereby impede sliding movement of the ski. The elongated member 16 will tend to be most effective in impeding sliding movement of the ski 10 in its forward direction whereas the elongated member 14 may tend to be deflected by such sliding movement. On the other hand, the elongated member 14 will tend to be most effective in preventing sliding movement of the ski 10 in a rearward direction although the elongated member 16 may tend to be deflected upwardly by such rearward sliding movement. Both elongated members 14 and 16 will impede any sideways sliding movement of the ski 10 although such sideways sliding movement is not common.

The portions of the elongated members 14 and 16 which project above the upper surface of the ski 10 are adapted to be engaged by the boot of the skier when the ski 10 is attached thereto. Such engagement will tend to force the elongated members 14 and 16 to assume the positions shown in FIGS. 2 and 4. In such position the elongated members are generally aligned with the ski 10 and no portion of either elongated member 14 or 16 projects below the lower surface of the ski 10. Thus, in the position shown in FIGS. 2 and 4, the ski stop assembly 12 will not impede the sliding movement of the ski 10.

Figure 5:
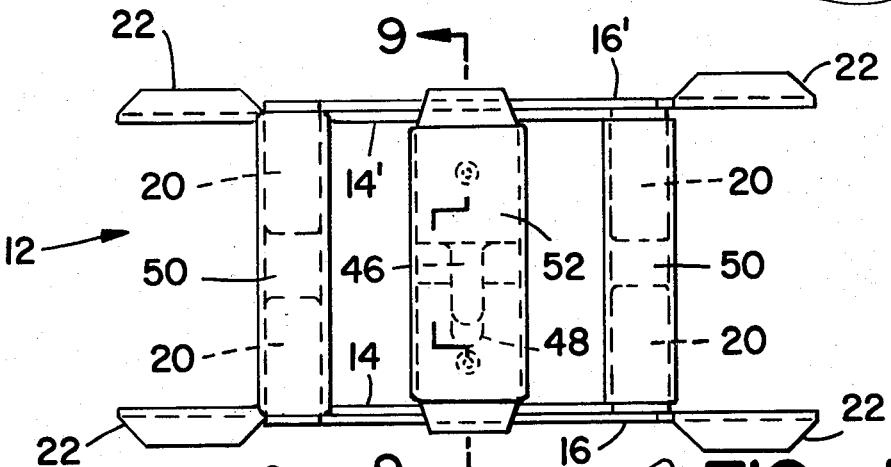
FIG. 5 is a top plan view of FIG. 3 with the phantom showing of the ski omitted.

Although all skis in common usage today tend to have a common minimum thickness, such skis are made in varying lengths and more importantly in varying widths. According to the teaching of this invention, skis of varying widths are accommodated by mounting each pair of elongated members independently as best shown in FIGS. 5 and 6. Thus, referring to FIG. 7, the elongated members 14 and 16 of each pair each have first 20 and second 22 flanges extending in opposite directions laterally of the axis of elongation of the elongated member 14, 16 at opposite ends thereof. The portion of the elongated members 14, 16 intermediate the flanges 20, 22 is rectilinear and has an aperture 26 formed therethrough at the same given point between the flanges 20, 22. Thus, a pair of elongated members 14 and 16 may be mounted for pivotal movement in opposite directions to provide a scissor like action by aligning the apertures 26 thereof to receive a common axle.

As shown in FIG. 7, a torsion spring 28 is sandwiched between the elongated members 14 and 16 of each pair. Each torsion spring 28 is adapted to be aligned with the apertures 26 through the associated pair of elongated members 14, 16 with the opposite ends thereof each adapted to be mechanically attached to a different one of the pair of elongated members 14, 16. The torsion spring 28 associated with each pair of elongated members 14, 16 is adapted to urge the associated pair of elongated members 14, 16 toward the position thereof shown in FIG. 3.

Figure 4:
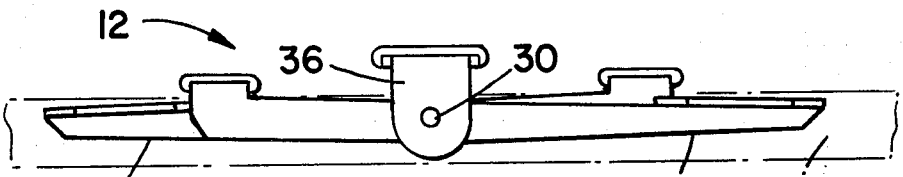
FIG. 4 is an enlarged fragmentary side view in elevation of the ski stop assembly of FIG. 2.

In the preferred embodiment of this invention as best shown in FIGS. 7 and 8 the apertures 26 of the elongated members 14, 16 are countersunk to receive the torsion spring 28 and associated groove is provided to receive the ends of the torsion spring 28 so that the torsion spring will be fully enclosed by the elongated members 14, 16 when they are in the position shown in FIG. 4. It is important to note that although the countesinking of the apertures 26 in the elongated members 14, 15 is identical in all other respects, it is done on opposite or nonmirror image sides of the elongated members 14, 16. The countersinking of the apertures 26 of the elongated members 14, 16 on one side of the ski 10 may be the mirror image of the countersinking of the apertures 26 in the corresponding elongated members 14', 16' at the other side of the ski 10 but need not be if the order of the elongated members in the pair are reversed. In any event, the pair of elongated members from one side of the ski 10 can be substituted for the pair of elongated members on the other side of the ski 10 by simply turning the pair of elongated members end for end.

Referring to FIG. 9 a pair of elongated members 16, 14 are mounted on the side of the ski 10 by means of an axle 20 carried by a support member 32 extending along the side of the ski 32. The axle 30 projects normally to the axis of elongation of the ski 10 and is received through the apertures 26 in the elongated members 14 and 16 as well as through the torsion spring Preferably the support or mounting 32 comprises a flange on a mounting plate with the late portion 34 of the mounting plate fixed to the upper surface of the ski 10 and the flange 32 extending contiguously along the side of the ski 10.

The axle 20 may be provided with any appropriate means at its free end to retain the elongated members thereon. However, it is necessary to provide means for stopping rotation of the pair of elongated members under the influence of the spring 28 so that the elongated members project at an angle with respect to the axis of elongation of the ski. Such stop means is required in order to cause the elongated member 16, for example, to wedge in the snow upon forward sliding motion of the ski 10 or to cause the elongated member 14 to wedge in the snow upon rearward sliding motion of the ski 10.

Without such stop means the elongated members would tend to be deflected against the force of the torsion spring 28 or to continue their rotation under the influence of the torsion spring 28 until the flanges 22 are in contact with the elongated members extending substantially perpendicular to the axis of elongation of the ski 10. In either event the ski stop assembly 12 would be less effective in impeding sliding motion of the ski 10.

Thus, in the preferred embodiment of this invention, a second mounting plate having a flange 36 overlapping the flange 32 in spaced parallel relation thereto is provided. The plate portion 38 of the second mounting plate is fastened to the top surface of the ski 10 together with the plate portion 34 of the first mounting plate. The flange 36 of the second mounting plate is provided with an aperture adapted to receive the free end of the axle 30 with the elongated members sandwiched between the flange 36 and the flange 32. In this embodiment of the invention the axle 30 may be a rivet having its head 40 countersunk in the flange 32 of the first mounting plate and swaged at the outer surface of the flange 36 of the second mounting plate for example.

It would, of course, be possible to provide the support members or flanges 32 and 36 in a single integral mounting plate or to mount the plate portions 34 and 38 of the mounting plates in contiguous relation to each other on the top surface of the ski 10. However, in the preferred embodiment of this invention as shown in the drawing, a spacer plate 42 is sandwiched between the plate portions 34 and 38 of the mounting plates. Such spacer plate enables the plate portion 38 of the second mounting plate to act as the means for stopping rotation of the elongated members 14 and 16 at the desired angle with respect to the axis of elongation of the ski 10 and provides a simple and inexpensive structure.

The plate portions 34 and 38 of the mounting plates and the spacer plate 42 may be affixed to the upper surface of the ski in any convenient manner as for example by means of a screw 44 as shown in the drawing.

Referring to FIG. 5 in the preferred embodiment of this invention the mounting plates and spacer plate for the pair of elongated members at one side of the ski 10 is provided with a tongue adapted to project along the upper surface of the ski 10 and the mounting plates 34, 38 and spacer plate 42 for mounting the elongated members 14 and 16 to the other side of the ski is provided with a groove 48 to receive the tongue 46. This arrangement will permit the ski stop assembly 12 to be adjusted to accommodate any width of ski while providing additional rigidity which will tend to prevent the pairs of elongated members from being twisted with respect to the axis of elongation of the ski 10.

Also in the preferred embodiment of this invention a pair of flange covers 50 may be provided as best shown in FIG. 5. Such flange covers 50 may be tubular or channel shaped in cross-section and adapted to receive the flanges 20 in opposite ends thereof with a loose fit. Such channel covers may be made of a rigid plastic or other material in order to interconnect the two pairs of elongated members for the transfer of forces therebetween tending to cause rotation of the elongated members. However, they need not be made of rigid material in which case they would still provide a protective or aesthetic function. Similarly, a mounting plate cover 52 which is channel shaped in cross-section and adapted to snap over the second mounting plate may be provided. Such mounting plate cover may be made of rigid material in order to add mechanical rigidity to the assembly but may merely serve a protective or aesthetic function.

It will be seen that the ski stop assembly according to the teaching of this invention is simple and inexpensive to fabricate. The scissors action of the ski stop assembly will tend to eliminate the possible clogging of the assembly which ice and snow during use, thus tending to ensure that the assembly will function as desired when needed. In the preferred embodiment of this invention the elongated members 14 and 16 are made of flat stock material with integrally formed flanges and are mirror images of each other except for the countersinking of apertures 26 and the associated grooves. The flanges 22 will, of course, enhance the action of the assembly in stopping sliding movement of the ski 10 and may be integrally formed with the elongated member. Similarly, the flanges 20 are preferably integrally formed on the flat stock material. The flanges 20 and 22 may take any appropriate shape suitable for their function.

It is believed that those skilled in the art will make obvious modifications in the ski stop assembly as specifically shown in the drawing and described herein without departing from the scope of the following claims.

I claim:

1. A ski stop assembly for impeding the sliding movement of a ski upon release of said ski from a skier's boot, comprising:

(a) a pair of elongated members of the same given length substantially greater than the thickness of said ski, each of said pair of elongated members having first and second flanges projecting laterally therefrom in opposite directions at opposite ends thereof with the portions of each of said pair of elongated members intermediate said first and second flanges being rectilinear and with each elongated member having an aperture therethrough at the same given point intermediate said first and second flanges;

(b) means for mounting said pair of elongated members on a side of said ski with said first flange of each of said pair of elongated members extending over the top of said ski for engagement by the bottom of a skier's boot and said second flange of each of said pair of elongated members extending away from said side of said ski, said means for mounting said pair of elongated members including an axle extending normally to the axis of the elongation of said ski, a first mounting member extending contiguously along the side of said ski spaced from the bottom surface of said ski and having an aperture therethrough normal to the axis of elongation of said ski and a second mounting member extending along the side of said ski spaced from the bottom surface of said ski and overlapping said first mounting member; said second mounting member being spaced from said first mounting member laterally of the axis of elongation of said ski and having an aperture therethrough normal to the axis of elongation of said ski in registry with said aperture through said first mounting member; said pair of elongated members being sandwiched between said first and second mounting members with said apertures therethrough in alignment with each other and with said aperture through said first and second mounting members; and said axle member being received in said apertures through said first mounting member, said pair of elongated members and said second mounting member to enable rotation of said elongated members in opposite directions with respect to each other about a common axis between a first position in which said first flanges of said pair of elongated members are spaced above the top of said ski with said second flanges projecting below the bottom of said ski and a second position in which said first flanges of said pair of elongated members are substantially in contact with the top of said ski with said second flanges in substantial alignment with the side of said ski;

(c) a torsion spring received about said axle and between said pair of elongated members, said torsion spring urging said pair of elongated members to rotate in opposite directions about said common axis of said axle toward said first position thereof with respect to said ski; and (d) means for stopping rotation of said pair of elongated members toward said first position thereof with said elongated members extending at an angle to the axis of elongation of said ski.

2. A ski stop assembly as claimed in claim 1 wherein each of said first and second mounting members have a plate portion extending over the top surface of said ski and said means for mounting said pair of elongated members includes means for affixing said plate portions of said first and second mounting members to said top surface of said ski.

3. A ski stop assembly as claimed in claim 2 including a spacer plate sandwiched between said plate portions of said first and second mounting members.

4. A ski stop assembly as claimed in claim 1 wherein said pair of elongated members are each a mirror image of the other made of flat stock and are mounted with flat surfaces of said intermediate portions thereof facing each other, and wherein said apertures through said elongated members are countersunk at said facing flat surfaces of said intermediate portions of said elongated members which are also grooved to receive and fully enclose said torsion spring when said elongated members are in said second position thereof.

5. A ski stop assembly as claimed in claim 3 including:

(e) a second pair of elongated members of the same given length substantially greater than the thickness of said ski, each of said second pair of elongated members having first and second flange members projecting laterally therefrom in opposite directions at opposite ends thereof, with the portions of each of said second pair of elongated members intermediate said first and second flange members thereof being rectilinear and with each elongated member of said second pair having an aperture therethrough at the same given point intermediate said first and second flange members thereof;

(f) means for mounting said second pair of elongated members on a side of said ski opposite said first pair of elongated members with said first flange member of each of said second pair of elongated members extending over the top of said ski for engagement by the bottom of a skier's boot and said second flange member of each of said second pair of elongated members extending away from said side of said ski, said means for mounting said second pair of elongated members including a first mounting member extending contiguously along the side of said ski spaced from the bottom surface of said ski and having an aperture therethrough normal to the axis of elongation of said ski, a second mounting member extending along the side of said ski spaced from the bottom surface of said ski and overlapping said first mounting member, said second mounting member being spaced from said first mounting member laterally of the axis of elongation of said ski and having an aperture therethrough normal to the axis of elongation of said ski in registry with said aperture through said first mounting member, said pair of elongated members being sandwiched between said first and second mounting members with said apertures therethrough in alignment with each other and with said apertures through said first and second mounting members, and an axle member extending normally to the axis of elongation of said ski and received through said apertures of said first mounting member, said pair of elongated members and said second mounting member, each of said first and second mounting members including a plate portion extending over the top surface of said ski, a spacer plate sandwiched between said plate portions of said first and second mounting means, and means for fixing said plate portions of said first and second mounting members together with said spacer plate to said top surface of said ski to enable rotation of said second pair of elongated members in opposite directions with respect to each other about a common axis between a first position in which said first flange members of said second pair of elongated members are spaced above the top of said ski and a second position in which said first flange members of said second pair of elongated members are substantially in contact with the top of said ski;

(g) a torsion spring received about said axle and between said second pair of elongated members, said torsion spring urging said second pair of elongated members to rotate in opposite directions about said common axis of said axle toward said first position thereof with respect to said ski; and (f) means for stopping rotation of said second pair of elongated members toward said first position thereof with said elongated members of said second pair extending at an angle to the axis of elongation of said ski.

6. A ski stop assembly as claimed in claim 5 wherein the adjacent ends of said plate portions of said first and second mounting members for each of said first and second pairs of elongated members have an interfitting tongue and groove configuration when mounted on the top surface of said ski and wherein a pair of tubular members is provided, each said tubular member receiving a different one of said first flange members of said first pair of elongated members and a corresponding one of said first flange members of said second pair of elongated members in opposite ends thereof.

* * * * *